US005205858A

United States Patent [19]

Manke

[11] Patent Number: 5,205,858

[45] Date of Patent: Apr. 27, 1993

[54] PRECIOUS METALS RECOVERY PROCESS

[76] Inventor: Michael D. Manke, 905 ½ 10th St., Apt. 4, Spearfish, S. Dak. 57783

[21] Appl. No.: 833,060

[22] Filed: Feb. 10, 1992

[51] Int. Cl.[5] ..... C22B 11/00

[52] U.S. Cl. ..... 75/426; 75/428

[58] Field of Search ..... 75/426, 428

[56] References Cited

U.S. PATENT DOCUMENTS 2,147,009 2/1939 Chapman ..... 423/25

OTHER PUBLICATIONS

Ammen Recovery and Refining of Precious Metals TN760A5 Dec. 1985 pp. 10 to 16, 24 and 25.

*Primary Examiner*—Melvyn J. Andrews

[57] ABSTRACT

Standard cyanide-extraction techniques are coupled with carbon adsorption to facilitate the recovery of precious metals. The carbon is in the minus eighty mesh size range and is removed from a slurry by flotation. The loaded carbon is then dried and destroyed by direct fusion to produce doré bullion.

1 Claim, 4 Drawing Sheets

LOADED CARBON TREATMENT

CARBON ADSORPTION PROCESS
SLURRY PREPARATION TANK
26
$H_2O$
28
PUMP
30
COLUMN FLOTATION CELL
32
LIME FEEDER
36
CYANIDE FEEDER
38
AIR LIFT COMPRESSOR
34
FINE CARBON FEEDER
40
FLOTATION REAGENT FEEDER
42
TAILINGS
LOADED CARBON

TAILINGS TREATMENT

FUSION PROCESS OPTIONS

PRECIOUS METALS RECOVERY PROCESS

BACKGROUND OF THE INVENTION

1. Field of the Invention

The present invention relates to recovery systems for precious metals, and more particularly pertains to a new and improved metals recovery system which utilizes standard cyanide-extraction techniques coupled with carbon adsorption.

2. Description of the Prior Art

There are numerous patents which disclose cyanide extraction and carbon adsorption techniques for precious metals recovery. For example, U.S. Pat. No. 4,177,068, which issued to Balakrishnan, et al. on Dec. 4, 1979, describes a process for the extraction of gold and silver from their ores in which the ore is reduced to a particle size of one millimeter or less and is then mixed with a lixiviant, e.g., an alkaline sodium or potassium cyanide, in an amount to provide a liquor content of about 8 to 12 percent. The lixiviant coated particles are allowed to react for a time sufficient for the lixiviant to extract the noble metal, and the particles are washed with water to obtain a solution of the noble metal salt from which the noble metal is covered. This patent is representative of a number of patents which disclose cyanide extraction techniques for gold and silver.

Another patent of interest is U.S. Pat. No. 4,374,097 which issued to Larry Holland on Feb. 15, 1983. This patent is directed to a method for extracting precious metals from their ores wherein the ore is particulated and mixed with a binding agent to form a paste. The paste material is discharged into a rotary drum at an extruding station where it is pelletized by forcing it through a perforated sidewall of the drum. The pellets are discharged onto a conveyor belt and are transported to a spray station where they are wetted with a lixiviant solution. The lixiviant coated pellets are then dried by exposure to a heated air stream at a drying station while being transported to an open air curing stockpile. The cured pellets are heaped in a pile and are then washed in a water spray to yield a pregnant solution of a precious metal salt.

Also of interest is U.S. Pat. No. 3,920,403 which issued to J. Ross on Nov. 18, 1975. This patent is directed to a method of gold extraction wherein gold in the form of its cyanide complex is desorbed from activated carbon by contacting the carbon with a stripping liquid at a temperature above 130 degrees centigrade but below the decomposition temperature of the gold cyanide complex. The stripping liquid may comprise water, dilute caustic or dilute caustic cyanide.

In recent years, gold and silver extraction techniques which utilize cyanide and carbon adsorption procedures have been refined to the extend that it is now economically feasible to employ these techniques to obtain noble metals from formerly discarded waste materials (often referred to a tailings). More particularly, even the smallest improvements in these existing processes often makes it feasible to recycle such tailings to obtain gold and silver which was not removed during a prior extraction process. As such, there is a continuing need for further refinements to such processes whereby virtually all of the noble metals could be recovered from processed ore and in this respect, the present invention substantially fulfills this need.

In summary, the precious metal recovery system according to the present invention substantially departs from the conventional concepts and designs of the prior art, and in so doing provides a system primarily developed for the purpose of combining cyanide extraction techniques with carbon adsorption, followed by carbon recovery through froth flotation.

SUMMARY OF THE INVENTION

In view of the foregoing disadvantages inherent in the known types of precious metal recovery systems now present in the prior art, the present invention provides an improved precious metal recovery system wherein standard cyanide-extraction techniques are combined with carbon adsorption to obtain improved precious metal recovery. As such, the general purpose of the present invention, which will be described subsequently in greater detail, is to provide a new and improved precious metals recovery system which has all the advantages of the prior art precious metal recovery systems and none of the disadvantages.

To attain this, the present invention utilizes carbon in the minus 80 mesh size range which is removed from a slurry by flotation. The loaded carbon is then dried and destroyed in direct fusion to produce doré bullion. Initially, standard evaluation is performed to determine the most favorable lime and cyanide additions, grinding requirements, and retention times. Carbon addition to remove all of a particular precious metal, such as gold, in cyanide is slightly different as far as evaluation is concerned, because it is apparent that fine carbon can load, i.e., absorb, upward to one thousand ounces of gold per ton of carbon, as opposed to the four hundred ounce neighborhood associated with coarse carbon usage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved precious metals recovery system which has all the advantages of the prior art precious metal recovery systems and none of the disadvantages.

It is another object of the present invention to provide a new and improved precious metals recovery system utilizing an associated apparatus structure which may be easily and efficiently manufactured and marketed.

It is a further object of the present invention to provide a new and improved precious metals recovery system which is of a durable and reliable construction.

An even further object of the present invention is to provide a new and improved precious metals recovery system which is susceptible of a low cost of manufacture with regard to both materials and labor, and which accordingly is then susceptible of low prices of sale to the consuming public, thereby making such precious metals recovery systems economically available to the buying public.

Still yet another object of the present invention is to provide a new and improved precious metals recovery system which provides in the apparatuses and methods of the prior art some of the advantages thereof, while simultaneously overcoming some of the disadvantages normally associated therewith.

Still another object of the present invention is to provide a new and improved precious metals recovery system and associated apparatus structure which utilizes a much finer carbon granule size to effect precious metal adsorption.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
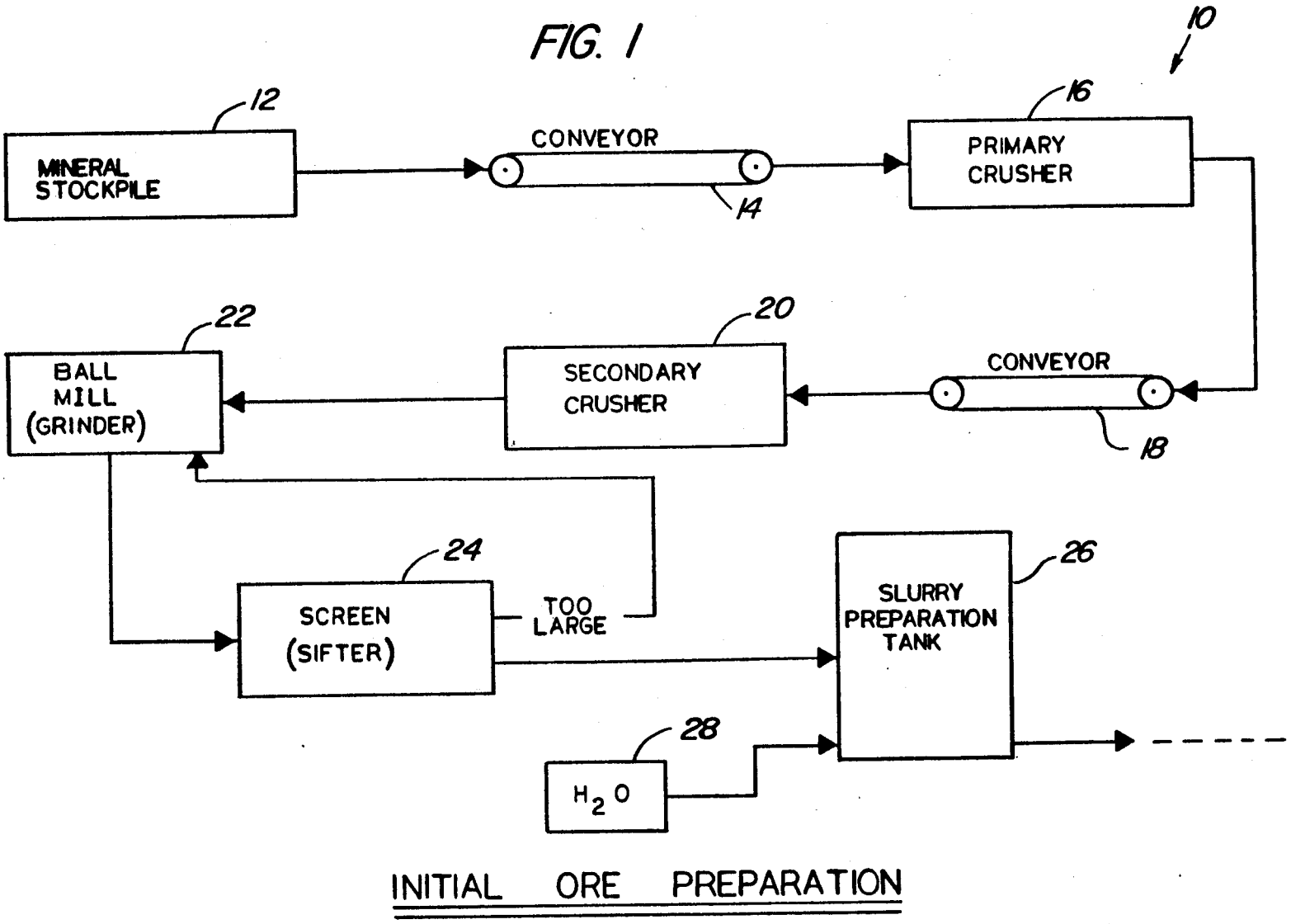
FIG. 1 is a schematic representation of the initial ore preparation phase associated with the present invention.

With reference now to the drawings, and in particular to FIG. 1 thereof, a new and improved precious metal recovery system embodying the principles and concepts of the present invention and generally designated by the reference numeral 10 will be described.

More specifically, the present invention utilizes standard cyanide-extraction techniques coupled with carbon adsorption to effect precious metals recovery. Therefore one of the major differences of the present invention is that the carbon is in the minus eighty mesh size range and is removed from a slurry, as will be subsequently described, by flotation. In this regard, standard ore evaluation is initially performed to determine the most favorable lime and cyanide additions required. Also, the standard ore evaluation will determine the grinding requirements and the mixing and slurry retention times. Carbon addition to remove all metal from an ore is slightly different for each evaluation inasmuch as fine carbon can load upwards to one thousands ounces of a precious metal, such as gold, per ton of carbon, as opposed to the four hundred ounce neighborhood associated with course carbon usage.

As shown in FIG. 1, a mineral stockpile 12 is established and for purposes of description, it will be assumed that a mineral stockpile comprises essentially gold ore. The gold ore is transferred in selected amounts by means of a conveyor 14 to a conventional primary crusher 16. The primary crusher effects initial ore disintegration of a first desired size, and then a second conveyor 18 is utilized to deliver the preliminarily crushed ore to a secondary crusher 20. The secondary crusher 20 completes the ore disintegration to a size whereby it can be delivered to a ball mill 22 which grinds the ore to liberation sizes.

The ground ore is then delivered from the ball mill 22 to a sifting screen 24. The screen 24 sifts the ground ore and any of the pieces of ore which cannot pass through the screen are redelivered to the ball mill 22 for recycling. Once the ore has passed through the screen 24, it is delivered to a slurry preparation tank 26 for initial conditioning. In this step, a supply of water 28 is delivered to the slurry preparation tank 26 whereby the ore effectively leaves the crushing and grinding process as a slurry.

Figure 2:
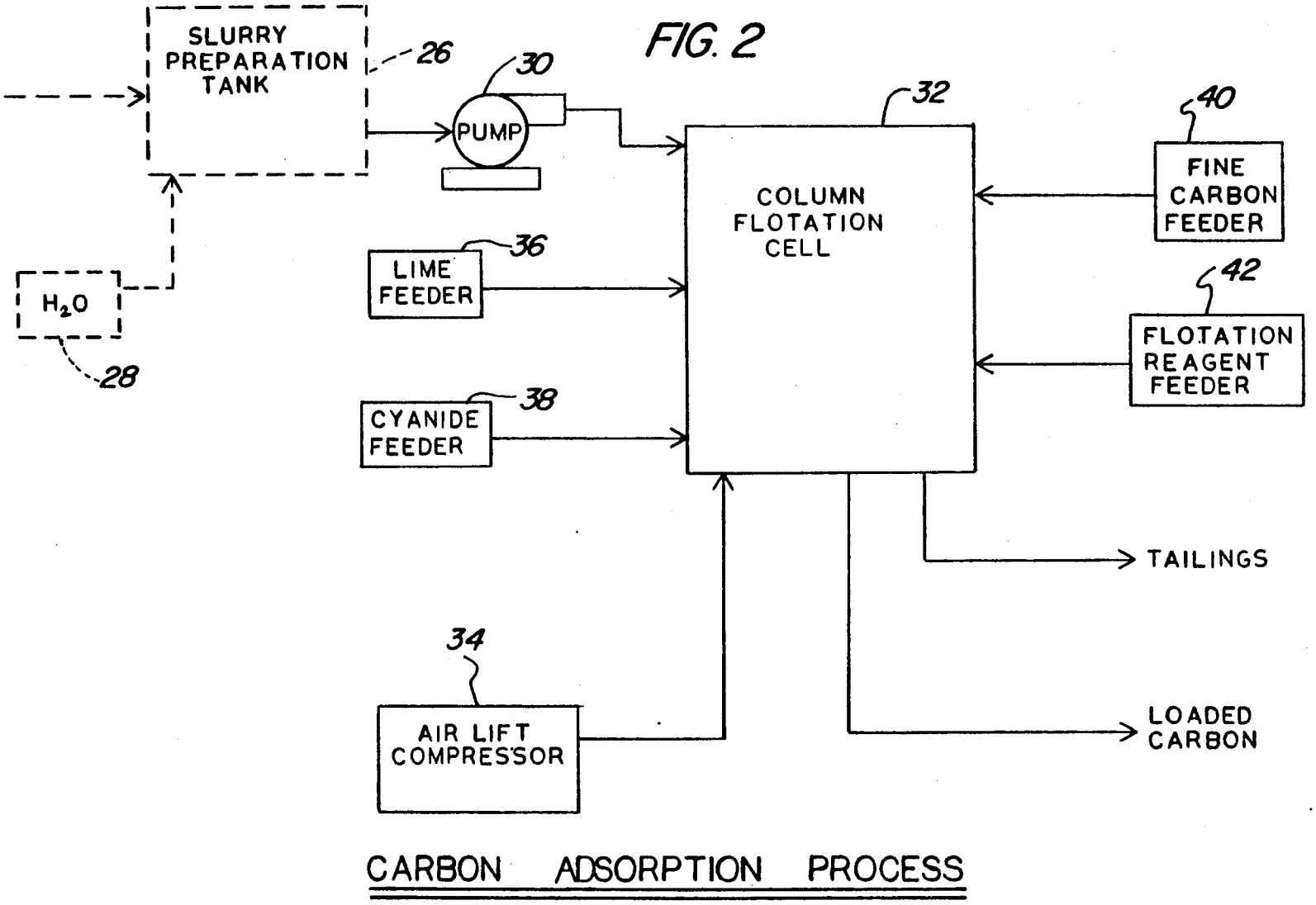
FIG. 2 is a schematic representation of the carbon adsorption process associated with the present invention.

As shown in FIG. 2, the pulp and water mix is removed from the slurry preparation tank 26 by a pump 30 and is delivered directly into a column flotation device 32 equipped with air lift capability. This capability is facilitated by an airlift compressor 34 which can be utilized to deliver a continuous supply of compressed air to the slurry contained within the column flotation cell 32.

Predetermined amounts of lime are then added from a lime feeder 36, and the lime is circulated in the slurry until the proper pH is reached (usually 10–12). Once the correct pH has been obtained, cyanide (preferably sodium cyanide) is added from a cyanide feeder 38 in such amounts as were determined by the preliminary ore evaluation. The cyanide operates to effect satisfactory precious metal compounding.

The combined cyanide, lime and slurry mass is then allowed to air-lift agitate for the calculated required residence time to effect all possible precious metal compounding. Air-lift agitation also makes available the necessary oxygen from the atmosphere to complete the cyanide/precious metal compounding reaction. Fine carbon is then added from a fine carbon feeder 40 and is allowed to air-lift agitate until the precious metals in the cyanide compound are fully adsorbed into the carbon. The exact loading nature of the fine carbon, i.e., the amount of precious metal per ton of carbon, and its residence-contact time to complete full adsorption can be determined by experiment.

Upon completion of full carbon adsorption, the air-lift agitation is discontinued and the flotation effect of the column is utilized. Pine oil or any carbon/gold specific flotation chemical can be used to remove the loaded carbon from the slurry. In this respect, pine oil is already utilized in the prior art to effect the flotation of carbon having gold adsorbed therewith, and the flotation chemical can be delivered to the column flotation cell 32 from a flotation reagent feeder 42. The loaded carbon and tailings are separately removed from the column flotation cell 32 at the completion of this stage of the process.

Figure 3:
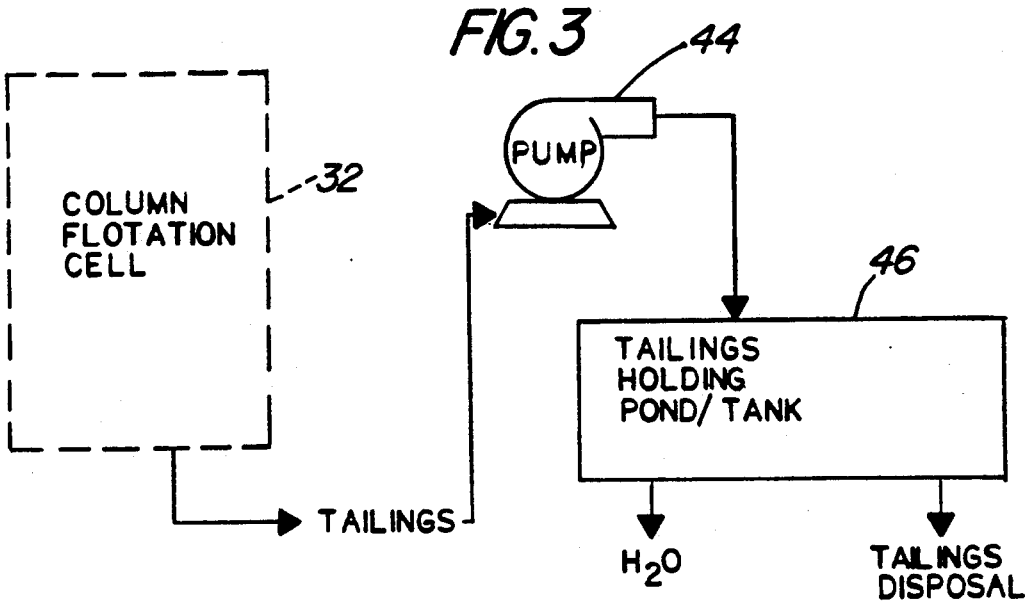
FIG. 3 is a schematic representation of the tailings treatment associated with the invention.

With respect to the removed tailings, reference is made to FIG. 3 of the drawings wherein it can be seen that the tailings are removed from the column flotation cell 32 by means of a pump 44 which delivers the tailings to a holding pond or tank 46. The tailings holding pond 46 may utilize any known type of clarifier or thickener, or some other type of solids-removal and fluid separation device or chemical. In effect, the tailings holding pond 46 is utilized to remove the tailings from the aforedescribed slurry, whereby the tailings may be disposed of separately from the water in which they were originally dispersed.

Figure 4:
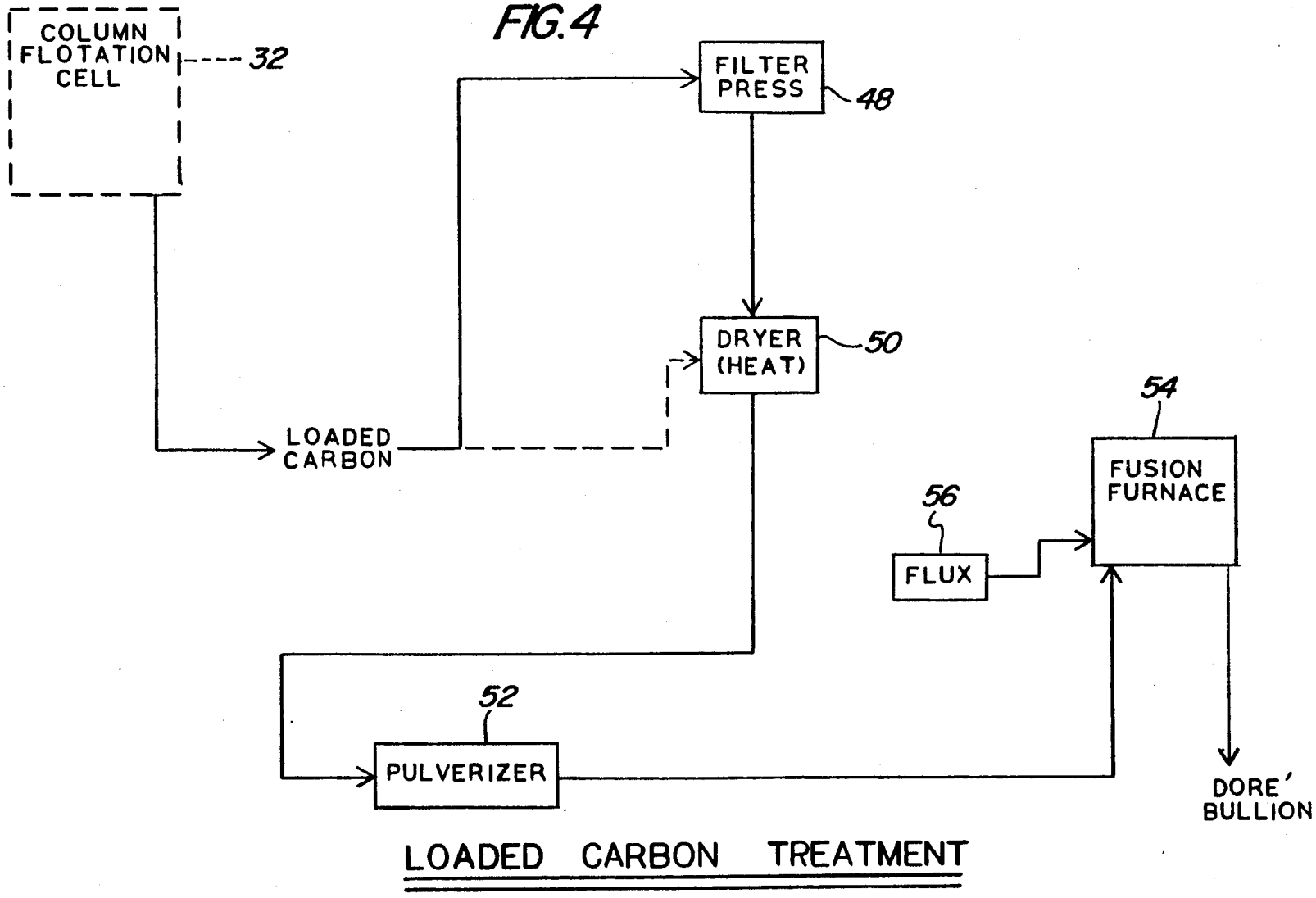
FIG. 4 is a schematic representation of the loaded carbon treatment process associated with the invention.

As shown in FIG. 4, the loaded carbon which is separately removed from the column flotation cell 32, is delivered to a filter press 48 where it is filtered to remove impurities and pressed to effect initial drying. The flotation carbon/gold material is then delivered to a dryer 50 wherein heat is utilized to remove water from the collected material. The material is then delivered to a pulverizer 52 where it is converted into pellets of a desired size, and the pelletized material is then delivered to a fusion furnace 54. The material is then directly fluxed with an oxidant 56 in the large capacity fusion furnace 54. In this regard, around 500 to one thousand pounds of loaded carbon could be fluxed during each treatment. The carbon should contain a sufficient amount of precious metals which would permit the metal to collect in fusion, although lead may have to be added.

Figure 5:
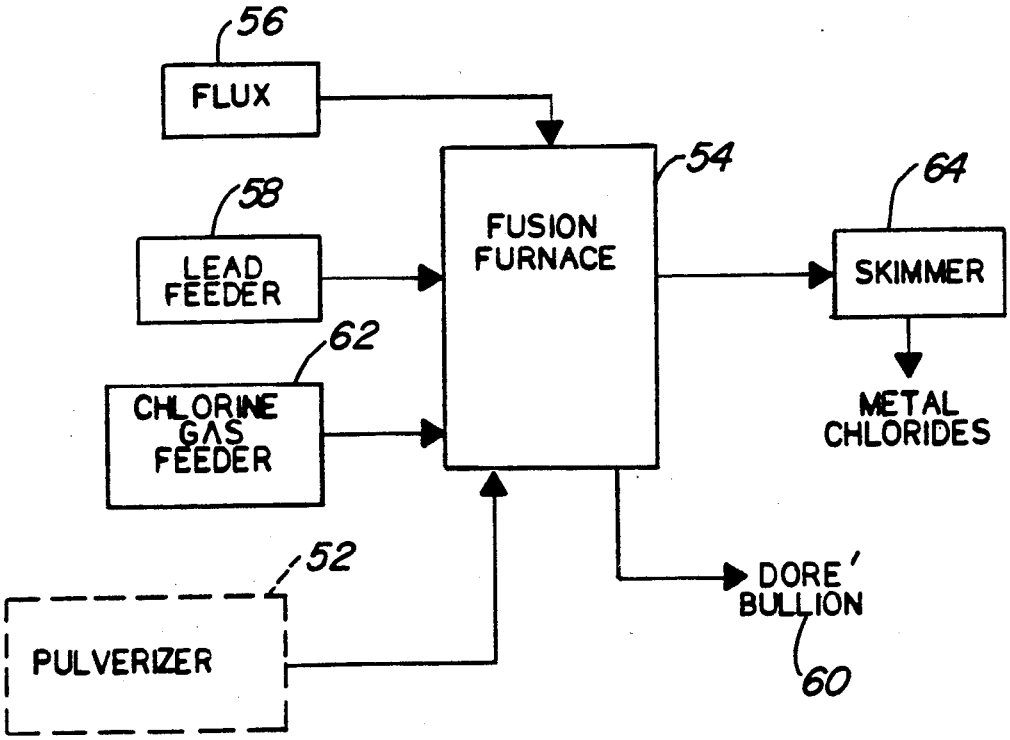
FIG. 5 is a schematic representation of the fusion process options associated with the invention.

FIG. 5 illustrates a fusion process option which includes the addition of lead by means of a lead feeder 58 associated with the fusion furnace 54. Final fluxing requirements may vary depending upon a number of factors but in any event, doré bullion 60 will be obtainable directly from the fusion process. Higher grade gold could be produced by chlorine gas lancing, as indicated by the chlorine gas feeder 62, and a skimmer 64 could be used to remove certain metal chlorides, such as silver or the like, prior to the gold pour itself within the furnace.

In summary, the above-described system removes the need for loaded carbon screen removal, carbon stripping circuits, electrowining, and carbon reactivation. Computerization of all phases is possible.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved precious metals recovery process for removing precious metals from a precious metals containing ore, the steps of said process comprising:

delivering a supply of said ore from a stock pile to a primary crusher to effect an initial disintegration thereof;

removing said ore from said primary crusher and delivering said ore to a secondary crusher to effect a greater disintegration thereof;

removing said ore from said secondary crusher and delivery said ore to a grinder to effect a further disintegration thereof, whereby said ore is effectively reduced in granular size;

removing said ore from said grinder and delivering said ore to a screen sifter;

recycling ore which does not pass though said screen sifter back to said grinder so as to effect a recycling thereof;

delivering said ore which passes though said screen sifter to a slurry preparation tank;

adding water to said slurry preparation tank so as to form a slurry formed from said water and said ore;

delivering said slurry from said slurry preparation tank to a column floatation cell;

delivering a continuous supply of air to said slurry within said column floatation cell, thereby to aerate said slurry and to effect an air-lift agitation thereof;

adding lime to said slurry in said column floatation cell until a pH in the range of about 10 to about 12 is obtained;

adding cyanide to said slurry after said pH has been obtained;

continuing said air-lift agitation of said slurry until maximum metal compounding has been achieved;

adding fine carbon of a particle size of minus 80 mesh to said slurry after said maximum metal compounding has been achieved, whereby noble metals are leached from said ore and are bonded to said fine carbon to create loaded carbon and leaving non-metal containing ore as tailings;

adding a floatation reagent comprising a carbon/noble metal specific chemical to said slurry so as to effect a separation of said loaded carbon and said tailings from said slurry;

removing said tailings from said floatation cell and delivering said tailings to a holding facility for further treatment;

removing said loaded carbon from said floatation cell and delivering said loaded carbon to a filter press;

filtering said loaded carbon in said filter press to remove impurities therefrom;

pressing said loaded carbon in said filter press to effect an initial drying thereof;

delivering said loaded carbon to a dryer to effect a removal of water through an applied application of thermal energy therefrom;

delivering said loaded carbon to a pulverizer so as to convert said loaded carbon into pellets;

delivering said pellets to a fusion furnace for providing an additional application of thermal energy;

adding an oxidant to said pellets in said fusion furnace during said application of thermal energy to said pellets, thereby to effect a fluxing thereof and causing precious metals to form into a doré bullion; and removing said doré bullion comprising said precious metals from said fusion furnace.

* * * * *